United States Patent [19]

More et al.

[11] Patent Number: 5,045,088

[45] Date of Patent: Sep. 3, 1991

[54] CHEMICAL COMPOSITIONS AND USE AS FUEL ADDITIVES

[75] Inventors: Iain More, Abingdon; Ian W. Harper, Oxford, both of United Kingdom; Wayne M. Camarco, Woodbridge, N.J.

[73] Assignee: EXXON Chemical Patents Inc., Linden, N.J.

[21] Appl. No.: 399,698

[22] Filed: Aug. 25, 1989

[30] Foreign Application Priority Data

Aug. 26, 1988 [GB] United Kingdom ..... 8820295

[51] Int. Cl.[5] ..... C10L 1/18

[52] U.S. Cl. ..... 44/393; 44/397; 44/400; 44/403

[58] Field of Search ..... 44/62, 70, 393, 394, 44/395, 397, 403, 400

[56] References Cited

U.S. PATENT DOCUMENTS

| | | | |
|---|---|---|---|
| 2,542,542 | 2/1951 | Lippincott et al. | 252/56 |
| 3,048,479 | 8/1962 | Ilnyckyj et al. | 44/62 |
| 3,252,771 | 5/1966 | Clough et al. | 44/62 |
| 3,444,082 | 5/1969 | Kautsky | 252/51.5 |
| 3,672,854 | 6/1972 | Rosenwald et al. | 44/66 |
| 3,961,916 | 6/1976 | Ilnyckyj et al. | 44/62 |
| 4,211,534 | 7/1980 | Feldman | 44/62 |
| 4,375,973 | 3/1983 | Rossi et al. | 44/62 |
| 4,402,708 | 9/1983 | Oswald | 44/66 |
| 4,569,679 | 2/1986 | Rossi | 44/62 |
| 4,661,121 | 4/1987 | Lewtas | 44/70 |
| 4,661,122 | 4/1987 | Lewtas | 44/70 |
| 4,713,088 | 12/1987 | Tack et al. | 44/62 |
| 4,810,260 | 3/1989 | Tack et al. | 44/62 |

FOREIGN PATENT DOCUMENTS

| | | |
|---|---|---|
| 061895 | 10/1982 | European Pat. Off. . |
| 153176 | 8/1985 | European Pat. Off. . |
| 153177 | 8/1985 | European Pat. Off. . |
| 213879 | 3/1987 | European Pat. Off. . |
| 5654037 | 12/1979 | Japan . |
| 55-40640 | 10/1980 | Japan . |
| 56-54038 | 12/1981 | Japan . |
| 1263152 | 2/1972 | United Kingdom . |
| 1364883 | 8/1974 | United Kingdom . |
| 1468588 | 3/1977 | United Kingdom . |
| 1469016 | 3/1977 | United Kingdom . |
| 2129012 | 5/1984 | United Kingdom . |

*Primary Examiner*—Jacqueline V. Howard
*Attorney, Agent, or Firm*—V. T. White

[57] ABSTRACT

The use as an additive to improve the low temperature properties of distillate fuels having a cloud point (wax appearance temperature) above 0° C. and containing more than 5 wt. % wax at 10° C. below the cloud point (wax appearance temperature) of a mixture of a comb polymer together with a poly-alkyl ester, ether, ester/ether of a polyhydroxy compound.

6 Claims, No Drawings

CHEMICAL COMPOSITIONS AND USE AS FUEL ADDITIVES

This invention relates to additives which are useful as wax crystal modifiers in fuels especially in distillate fuels with high wax contents and high cloud points.

It has long been known that various additives act as wax crystal modifiers when blended with waxy mineral oils. These compositions modify the size and shape of wax crystals and reduce the cohesive forces between the crystals and between the wax and the oil in such a manner as to permit the oil to remain fluid at lower temperature.

Various Pour Point depressants have been described in the literature and several of these are in commercial use. For example, U.S. Pat. No. 3,048,479 teaches the use of copolymers of ethylene and $C_1$ to $C_5$ vinyl esters, e.g. vinyl acetate, as pour depressants based on ethylene and higher alpha-olefins, e.g. propylene, are also known.

U.S. Pat. No. 3,961,916 teaches the use of a mixture of copolymers, to control the size of the wax crystals and United Kingdom Patent No. 1,263,152 suggests that the size of the wax crystals may be controlled by using a copolymer having a low degree of side chain branching. Both systems improve the ability of the fuel to pass through filters as determined by the Cold Filter Plugging Point (CFPP) test since instead of plate like crystals formed without the presence of additives the needle shaped wax crystals produced will not block the pores of the filter rather forming a porous cake on the filter allowing passage of the remaining fluid.

Other additives have also been proposed for example, United Kingdom Patent No. 1,469,016, suggests that the copolymers of di-n-alkyl fumarates and vinyl acetate which have previously been used as pour depressants for lubricating oils may be used as co-additives with ethylene/vinyl acetate copolymers in the treatment of distillate fuels with high final boiling points to improve their low temperature flow properties.

U.S. Pat. No. 3,252,771 relates to the use of polymers of $C_{16}$ to $C_{18}$ alpha-olefins obtained by polymerising olefin mixtures that predominate in normal $C_{16}$ to $C_{18}$ alpha-olefins with aluminium trichloride/alkyl halide catalysts as pour depressants in distillate fuels of the broad boiling, easy-to-treat types available in the United States in the early 1960's.

It has also been proposed to use additives based on olefin/maleic anhydride copolymers. For example, U.S. Pat. No. 2,542,542 uses copolymers of olefins such as octadecene with maleic anhydride esterified with an alcohol such as lauryl alcohol as pour depressants and United Kingdom Patent No. 1,468,588 uses copolymers of $C_{22}$ to $C_{28}$ olefins with maleic anhydride esterified with behenyl alcohol as co-additives for distill fuels.

Similarly, Japanese Patent Publication 5,654,037 uses olefin/maleic anhydride copolymers which have been reacted with amines as pour point depressants and in Japanese Patent Publication 5,654,038 the derivatives of the olefin/maleic anhydride copolymers are used together with conventional middle distillate flow improvers such as ethylene vinyl acetate copolymers.

Japanese Patent Publication 5,540,640 discloses the use of olefin/maleic anhydride copolymers (not esterified) and states that the olefins used should contain more than 20 carbon atoms to obtain CFPP activity.

United Kingdom Patent 2,192,012 uses mixtures of esterified olefin/maleic anhydride copolymers and low molecular weight polyethylene, the esterified copolymers being ineffective when used as sole additives. The patent specifies that the olefin should contain 10–30 carbon atoms and the alcohol containing 22–40 carbon atoms.

U.S. Pat. Nos. 3,444,082; 4,211,534; 4,375,973 and 4,402,708 discussed previously suggest the use of certain nitrogen containing compounds.

United Kingdom Patent No. 1,364,883 describes the use of additive mixtures containing conventional flow improvers of the type suggested in the Patents mentioned above together with compounds having a bulky substituent which although being themselves ineffective additives in the fuels with which the Patent is concerned, typically United States and Middle Eastern derived fuels of cloud points below 0° C. available at the time enhance the performance of the flow improver. Examples of compounds with bulky substituents include polyoxyalkylene compounds such as ethoxylated Sorbitol.

Recently, particularly in Asia and Australia, higher wax content fuels with cloud points wax appearance temperatures above 0° C. have become available and it has proved impossible to improve their low temperature properties with existing flow improvers. The cloud point wax appearance temperature being the temperature at which wax begins to precipitate from the fuel as measured by the test IP 219 ASTM 2500. The high wax content of these fuels as measured by DSC at a specified temperature below the wax appearance temperature leads not only to low temperature flow and fillerability problems but excessive wax settling on storage and blockage of flow lines from storage vessels and deposits in transporters, typically these fuels contain more than 5 wt % wax at 10° C. below their cloud point and contain a higher proportion of higher n-alkanes (above $C_{17}$) in the wax.

We have now found that by using a particular combination of additives the low temperature properties of such fuels may be significantly improved in particular we have found that by using a particular additive combination the tendency of the wax crystals to settle in the fuel during storage is reduced as well as enhancing the filterability performance of the fuel.

The compound may conveniently be dissolved in a suitable solvent to form a concentrate of from 20–90, e.g. 30 to 80 weight % in the solvent. Suitable solvents include kerosene, aromatic naphthas, mineral lubricating oils etc. The Wax Appearance Temperature (WAT) of the fuel is measured by differential scanning calorimetry (DSC). In this test a small sample of fuel 5 microliter samples of fuel are cooled at 2° C./minute together with a reference sample of similar thermal capacity but which will not precipitate wax in the temperature range of interest (such as kerosene).

The present invention therefore provides the use as an additive to improve the low temperature properties of distillate fuels having a cloud point wax appearance temperature above 0° C. and containing more than 5 wt. % wax at 10° C. below the cloud point of a mixture of a comb polymer of the general formula

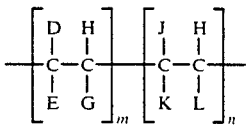

Where

D=R, —CO.OR, —OCO.R, —R'CO.OR or —OR

E=H or —$CH_3$ or D or R'

G=H, or D m=1.0 (homopolymer) to 0.4 (mole ratio)

J=H, —R', —Aryl or Heterocyclic group, —R'-CO.OR

K=H, —CO.OR', —OCO.R', —OR', —$CO_2H$

L=H, —R', —CO.OR', —OCO.R', —Aryl, —$CO_2H$ n=0.0 to 0.6 (mole ratio)

R=≧$C_{10}$ n-alkyl

R'=>$C_1$ hydrocarbyl

Optionally containing other monomers together with a fuel soluble poly-alkyl ester, ether, ester/ether.

The best effect is usually obtained when the fuel of the invention also contains other additives known for improving the cold flow properties of distillate fuels generally.

The amount of the combination added to the distillate fuel oil is preferably 0.001 to 0.5 wt. %, for example 0.01 to 0.10 wt. % based on the weight of fuel.

Examples of suitable comb polymers are the fumarate/vinyl acetate copolymers particularly those described in our European Patent Publications 0153176, 0153177, 0153176 and 0153177 and esterified olefin/-maleic anhydride copolymers and the polymers and copolymers of alpha olefins and esterified copolymers of styrene and maleic anhydride.

Examples of suitable polyalkyl esters are the Sorbitol derivatives such as Sorbitan tristearate commercially available as Span 65, the alkyl groups in the compounds are preferably linear.

Co additives may also be present and Examples of such compounds are esters, ethers or ester/ethers which may be used form the subject of European Patent Publication 0,061,895 A2 and may be structurally depicted by the formula:

R—O(A)—O—R'' where R and R'' are the same or different and may be i) n-alkyl— ii) n-alkyl

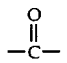

iii) n-alkyl

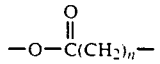

iv) n-alkyl

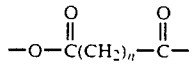

The alkyl group being linear and saturated and containing 10 to 30 carbon atoms, and A represents the polyoxyalkylene segment of the glycol in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be sustantially linear, A may also contain nitrogen in which case the product may contain more than 2 alkyl groups.

Suitable gylcols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$ to $C_{24}$ fatty acid, especially behenic acids. The esters may also be prepared by esterifying polyethoxylated fatty acids or polyethoxylated alcohols.

Polyoxyalkylene diesters, diethers, ether/esters and mixtures thereof are suitable as additives with diesters preferred for use in narrow boiling distillates whilst minor amounts of monoethers and monoesters may also be present and are often formed in the manufacturing process. It is important for additve performance that a major amount of the dialkyl compound is present. In particular, stearic or behenic diesters or polyethylene glycol, polypropylene glycol or polyethylene/polypropylene glycol mixtures are preferred.

The present invention differs from that of United Kingdom Patent 1364883 in that we find that the cyclic compounds such as the polyethoxylated sorbitol esters and the compounds with branched alkyl groups are also effective in the high cloud point and high wax level fuels with which the present invention is concerned.

Other additives which may also be included in the fuels of the present invention are ethylene unsaturated ester copolymer flow improvers. The unsaturated monomers which may be copolymerised with ethylene include unsaturated mono and diesters of the general formula:

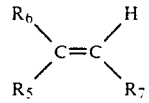

wherein $R_6$ is hydrogen or methyl, $R_5$ is a —$OOCR_8$ group wherein $R_8$ is hydrogen formate or a $C_1$ ot $C_{28}$, more usually $C_1$ to $C_{17}$, and preferably a $C_1$ to $C_8$, straight or branched chain alkyl group; or $R_5$ is —$OOCR_8$ group wherein $R_8$ is as previously described but is not hydrogen and $R_7$ is hydrogen or —$COOR_8$ as previously defined. The monomer, when $R_6$ and $R_7$ are hydrogen and $R_5$ is —$OOCR_8$, includes vinyl alcohol esters of $C_1$ to $C_{29}$, more usually $C_1$ to $C_5$, monocarboxylic acid. Examples of vinyl esters which may be copolymerised with ethylene include vinyl acetate, vinyl propionate and vinyl butyrate or isobutyrate, vinyl acetate being preferred. We prefer that the copolymers contain from 5 to 40 wt. % of the vinyl ester, more preferably from 10 to 35 wt. % vinyl ester. They may also be mixtures of two copolymers such as those described in U.S. Pat. No. 3,961,916. It is preferred that these copolymers have a number average molecular weight as measured by vapour phase osmometry of 1,000 to 10,000, preferably 1,000 to 5,000.

The distillate fuel may also contain polar compounds, either ionic or non-ionic, which have the capability in fuels of acting as wax crystals growth inhibitors. Polar nitrogen containing compounds have been found to be especially effective when used in combination with the glycol esters, ethers or ester/ethers and fuels containing such three component mixtures are within the scope of the present invention. These polar compounds are generally amine salts and/or amides formed by reaction of at least one molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$ to $C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctacedyl amine, methylbehenyl amine and the like. Amine mixtures are also suitable and many amines derived from natural materials are mixtures. The preferred amine is a secondary hydrogenated tallow amine of the formula $HNR_1R_2$ where in $R_1$ and $R_2$ are alkyl groups derived from hydrogented tallow fat composed of approximately 4% $C_{14}$, 31% $C_{16}$, 50% $C_{18}$.

Examples of suitable carboxylic acids and their anhydrides for preparing these nitrogen compounds include cyclohexane, 1,2 dicarboxylic acid, cyclohexene, 1,2-dicarboxylic acid, cyclopentane 1,2 dicarboxylic acid, naphthalene dicarboxylicacid and the like. Generally, these acids will have about 5–13 carbon atoms in the cyclic moiety.

Preferred acids useful in the present invention are benzene dicarboxylic acids such as phthalic acid, isophthalic acid, and terphthalic acid. Phthalic acid or its anhydride is particularly preferred. The particularly preferred compound is the amide-amine salt formed by reacting 1 molar portion of phthalic anhydride with 2 molar portions of di-hydrogenated tallow amine. Another preferred compound is the diamide formed by dehydrating this amide-amine salt.

Hydrocarbon polymers may also be included in the fuel of this invention and these may be represented with the following general formula:

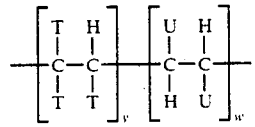

where

T=H or R′

U=H, T or Aryl v=1.0 to 0.0 (mole ratio)

w=0.0 to 1.0 (mole ratio)

where $R^1$ is alkyl.

These polymers may be made directly from ethylenically unsaturated monomers or indirectly by hydrogenating the polymer made from monomers such as isoprene, butadiene etc.

A particularly preferred hydrocarbon polymer is a copolymer of ethylene and propylene having an ethylene content preferably between 20 and 60% (w/w) and is commonly made via homogeneous catalysis.

The additive systems may conveniently be supplied as concentrates for incorporation into the bulk distillate fuel. These concentrates may also contain other additives as required. These concentrates preferably contain from 3 to 75 wt. %, more preferably 3 to 60 wt. %, most preferably 10 to 50 3t. % of the additives, preferably in solution in oil. Such concentrates are also within the scope of the present invention. The additives of this invention may be used in the broad range of distillate fuels boiling in the range 120° C. to 500° C. more particularly in fuels boiling in the range 140° to 400° C.

The invention is illustrated by the following examples, in which additives were tested in the following fuels

| Fuel | | 1 | 2 | 3 | 4 | 5 |
|---|---|---|---|---|---|---|
| Cloud Point (°C.) | | −16 | −9 | 0 | −5 | −6 |
| CFPP (°C.) | | | | −2 | 3.0 | 4 |
| Pour Point (°C.) | | −24 | −15 | −6 | 3 | 3 |
| Wax Content (wt. %) at 5° C. and 10° C. below wax appearance temperature | | 1.1/1.8 | 1.5/2.4 | 1.1/1.9 | 3.2/6.0 | 3.3/5.8 |
| ASTM D86 Distillation | IBP* | 178 | 168 | 164 | 179 | 222 |
| | 10% | | | 197 | 230 | 246 |
| | 20% | 230 | 231 | 210 | 244 | 255 |
| | 50% | 270 | 271 | 264 | 281 | 284 |
| | 90% | 318 | 325 | 340 | 333 | 335 |
| | FBP** | 355 | 350 | 371 | 356 | 364 |
| | 90%-20% | 88 | 94 | 130 | 89 | 80 |
| | FBP-90% | 37 | 25 | 31 | 23 | 29 |
| n-alkanes $>C_{17}$ (Wt. %) | | 4.0 | 6.3 | 6.84 | 10.8 | 14.3 |

*Initial Boiling Point

**Final Boiling Point

Fuels 1 to 3 being for comparison and were selected as being similar to those low wax fuels used in United Kingdom Patent No. 1364883.

By one method, the response of the oil to the additives was measured by the Cold Filter Plugging Point Test (CFPP) which is carried out by the procedure described in detail in "Journal of the Institute of Petroleum", Volume 52, Number 510, June 1966, pp.

173–285. This test is designed to correlate with the cold flow of a middle distillate in automotive diesels.

In brief, a 40 ml. sample of the oil to be tested is cooled in a bath which is maintained at about −34° C. to give non-linear cooling at about 1° C./min. Periodically (at each one degree c starting from above the cloud point), the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an are defined by a 12 millimeter diameter. The periodic tests are each initiated by applying a vacuum to the upper end of the pipette whereby oil is drawn through the screen up into the pipette to a mark indicating 20 ml. of oil.

After each successful passage, the oil is returned immediately to the CFPP tube. The test is repeated with each one degree drop in temperature until the oil fails to fill the pipette within 60 seconds. This temperature is reported as the CFPP temperature. The difference between the CFPP of an additive free fuel and of the same fuel containing additive is reported as the CFPP depression (ΔCFPP) by the additive. A more effective flow improver gives a greater CFPP depression at the same concentration of additive.

Another determination of flow improver effectiveness is made using the following "Filterability" proceedure.

PROCEDURE

1. Pour 200 gms of clean, dry sample into a preweighed jar 10 cm diameter and 7.5 cms in depth.

2. Cool the jar and its contents from a starting temperature 10° C. above cloud point to a target temperature at a rate of 1° C. per hour. The target temperature should be the required operability temperature for the fuel concerned.

3. At the end of a two hour period, gently stir the fuel once. Place a filter holder (of the type used in the CFPP test) which incorporates a screen of 20 mesh (840 micron), in the centre of the jar. Pump out the fuel using a vacuum of 500 mm of Hg. Ensure that the fuel remains at the target temperature during the pump-out.

4. Record both the time taken to pump-out the fuel (or block the filter) and the weight of fuel remaining.

5. A sample of warm, clear fuel (10° C. above cloud point) is pumped-out according to the stated method and wt. % residue of fuel is recorded. This is used as a standard.

The residual fuel and wax may then be calculated as follows

1.

$$\text{Wt. \% residue after cool down/pump-out} = \frac{A - B}{C} \times 100$$

where

A = weight of jar + fuel after pump-out

B = weight of empty jar

C = original weight of fuel

2. True weight of fuel remaining after pump-out wt. % residue after cool down − wt. % residue of standard. Fuels 1–3 had effectively zero fuel and wax residues.

To differentiate between the additives other CFPP filter assemblies with filter screens 30, 40, 60, 80, 100, 120, 150, 200 and 350 mesh number were used to determine the finest mesh (largest mesh number) the fuel will pass. The larger the mesh number that a fuel containing wax will pass, the smaller are the wax crystals and the greater the effectiveness of the additive flow improver. It should be noted that no two fuels will give exactly the same test results are the same treatment level for the same flow improving additive.

Wax settling studies were also performed on the fuel samples after specified lengths of time. The extent of the settled layer was visually measured by measuring the volume of cloudy fuel as a percentage of the total fuel volume. Thus extensive wax settling would be given by a low number whilst 100% indicates unsettled fluid fuel. Case must be taken because poor samples of gelled fuel with large crystals always exhibit high values, therefore these results are recorded as "gel".

In the Examples the following additives were used;

ADDITIVE A

An ethylene-vinyl acetate copolymer containing about 30 wt. % vinyl acetate, and has a number average molecular weight of about 1800 (VPO).

ADDITIVE B

The commercially available sorbitol tristearate commercially available as Crill 35.

ADDITIVE C

A copolymer of a 1.1 mole ratio of vinyl acetate and a $C_{14}$ straight chain alkyl fumarate of molecular weight. The amount of additives used and the performance in the fuels is shown in the following tables 1 to 4, tables 1 and 3 being for comparison.

TABLE 1

| | Fuel 1 | | | | | | | | |
|---|---|---|---|---|---|---|---|---|---|
| | CFPP | | | (a) FILTERABILITY (PCT Mesh Passed) | | | (b) WAS | | |
| AD-DITIVE | 100 ppm ai | 200 ppm ai | 400 ppm ai | 100 ppm ai | 200 ppm ai | 400 ppm ai | 100 ppm ai | 200 ppm ai | 400 ppm ai |
| B C(4:1) | 1.5 | 2.0 | 6.0 | 40 | 40 | 60 | 100 | 90 | 5 |
| B C(1:1) | 0.5 | 1.0 | 3.0 | 40 | 40 | 40 | 100 | 100 | 90 |
| B C(1:4) | 0.5 | 1.0 | 3.0 | 40 | 40 | 80 | 100 | 100 | 100 |
| B A(4:1) | 2.5 | 5.5 | 7.5 | 80 | 100 | 150 | 10 | 15 | 20 |
| B A(1:1) | 1.5 | 4.5 | 12.5 | 100 | 200 | 250 | 15 | 15 | 20 |
| B A(1:4) | 1.0 | 2.5 | 13.5 | 120 | 250 | 350 | 20 | 25 | 25 |
| B | −3.0 | −1.0 | −1.0 | 20 | 20 | 40 | gel | 30/100 | 30/100 |
| A | −1.0 | 2.0 | 6.5 | 40 | 40 | 80 | 30 | 70 | 90 |

TABLE 1-continued

| | Fuel 1 | | | | | | | | |
|---|---|---|---|---|---|---|---|---|---|
| | CFPP | | | (a) FILTERABILITY (PCT Mesh Passed) | | | (b) WAS | | |
| AD-DITIVE | 100 ppm ai | 200 ppm ai | 400 ppm ai | 100 ppm ai | 200 ppm ai | 400 ppm ai | 100 ppm ai | 200 ppm ai | 400 ppm ai |
| Base | | −15 | | | 80 | | | 100 | |

(a) Filter mesh passed after cooling at 1° C. hr$^{-1}$ to −21° C.
(b) Wax layer (volume %) after 2 hours settling at −21° C.

TABLE 2

| | Fuel 2 | | | | | | | | |
|---|---|---|---|---|---|---|---|---|---|
| | CFPP | | | (a) FILTERABILITY (PCT Mesh Passed) | | | (b) WAS | | |
| AD-DITIVE | 100 ppm ai | 200 ppm ai | 400 ppm ai | 100 ppm ai | 200 ppm ai | 400 ppm ai | 100 ppm ai | 200 ppm ai | 400 ppm ai |
| B C(4:1) | −0.5 | 2.0 | 2.0 | 20 | 30 | 40 | 80 | 80 | 10 |
| B C(1:1) | −1.0 | −0.5 | 1.0 | 20 | 40 | 80 | 90 | 90 | 90 |
| B C(1:4) | 1.5 | −1.0 | 0.5 | 20 | 40 | 100 | 95 | 100 | 90 |
| B A(4:1) | 1.5 | 3.0 | 4.0 | 40 | 80 | 120 | 10 | 5 | 30 |
| B A(1:1) | 2.5 | 4.5 | 7.5 | 80 | 100 | 120 | 10 | 10 | 50 |
| B A(1:4) | 3.0 | 4.5 | 10.5 | 80 | 100 | 150 | 10 | 10 | 40 |
| B | 3.0 | 3.5 | 4.0 | 40 | 60 | 8 | | | |
| A | 3.5 | 8.5 | 10.5 | 80 | 80 | 100 | | | |
| Base | | −10.0 | | | 20 | | | 70 | |

(a) Filter mesh passed after cooling at 1° C. hr$^{-1}$ to −15° C.
(b) Wax layer (volume %) after 2 hours settling at −15° C.

TABLE 3

| | Fuel 3 | | | | | | | | |
|---|---|---|---|---|---|---|---|---|---|
| | CFPP | | | (a) FILTERABILITY (PCT Mesh Passed) | | | (b) WAS | | |
| ADDITIVE | 100 ppm ai | 200 ppm ai | 400 ppm ai | 100 ppm ai | 200 ppm ai | 400 ppm ai | 100 ppm ai | 200 ppm ai | 400 ppm ai |
| B C(4:1) | 1.5 | 3.5 | 7.5 | 60 | 150 | 250 | 5 | 5 | 5 |
| B C(1:1) | 2.0 | 4.0 | 7.0 | 100 | 200 | 250 | 5 | 100 | 100 |
| B C(1:4) | 2.5 | 4.5 | 5.5 | 120 | 250 | 350 | 5 | 100 | 100 |
| B A(4:1) | 2.5 | 8.5 | 10.5 | 120 | 150 | 200 | 5 | 10 | 5/100 |
| B A(1:1) | 7.5 | 17.5 | 12.0 | 120 | 200 | 200 | 5 | 10 | 10 |
| B A(1:4) | 8.0 | 12.0 | 15.0 | 100 | 120 | 200 | 10 | 10 | 20 |
| B | −1.0 | 0 | 1.0 | 60 | 60 | 100 | 60 | 15 | 10 |
| A | 8.0 | 11.5 | 12.5 | 80 | 100 | 120 | 10 | 10 | 20 |
| Base | | 2.5 | | | 80 | | | 100 | |

(a) Filter mesh passed after cooling at 1° C. hr$^{-1}$ to −5° C.
(b) Wax layer (volume %) after 2 hours settling at −5° C.

No advantage over prior art is seen for the invention in fuels 1 to 3. These fuels are similar to those used in U.K. Patent Number 1364883.

Various other comb polymers were tested in combination with Additive B in Fuel 5 with the results set out in Table 5.

TABLE 4

| | Fuel 4 (a) | | | Fuel 5 (b) | | |
|---|---|---|---|---|---|---|
| ADDITIVE | CFPP | FILTERABILITY (WAX RESIDUE (c) | WAX LAYER (d) | CFPP | FILTERABILITY (WAX RESIDUE) | WAX LAYER |
| B C(4:1) | −0.5 | 1.0 | 100 | −2.0 | 69.5 | 100 |
| B C(1:1) | −1.5 | 1.5 | 50 | −1.5 | 0.5 | 100 |
| B C(1:4) | −1.5 | 3.5 | 50 | −2.5 | 2.8 | 100 |
| B A(4:1) | 0.5 | 2.5 | 90 | −3.0 | F(e) | 60 |
| B A(1:1) | −1.0 | 1.5 | 20 | 1.0 | 1.0 | 20 |
| B A(1:4) | 2.5 | 1.5 | 20 | 0 | 2.0 | 20 |
| B | | 1.8 | 97 | | F | 25 |
| A | 3.5 | 0 | 30 | 0.5 | 1.0 | 40. |
| Base | 4.0 | F | SOLID | 3.0 | F | SOLID |

(a) Treat rate 375 ppm ai
(b) Treat rate 625 ppm ai
(c) Wax residue % after sucking sample (under 500 mm Hg vacuum) through a 20 mesh filter.
(d) Wax layer (vol/vol %) after 1 week at 0° C.
(e) F = failed to suck out jar after 60 seconds Advantages in "Filterability" and WAS performance are seen for our invention over existing prior art.

TABLE 5

| Additive | Treat p.p.m. | Wax Residue[a] (Wt %) | Wax Layer[b] (Vol %) |
|---|---|---|---|
| B:$C_{14}$ IVAC[1] (1:1) | 625 | 3.5 | 80 |

TABLE 5-continued

| Additive | Treat p.p.m. | Wax Residue[a] (Wt %) | Wax Layer[b] (Vol %) |
|---|---|---|---|
| | 750 | 3.0 | 70 |
| B:$C_{14}$ Polyfumarate (1:1) | 625 | — | — |
| | 750 | 4.5 | 80 |
| B:$C_{16}$ SMEC (1:1)[2] | 625 | 8.5 | 100 |
| | 750 | 7 | 100 |
| B:$C_{16/18}$/SMEC[3] (1:1) | 625 | 7 | 100 |
| | 750 | 5.5 | 100 |
| B:$C_{16}$ PMA[4] (1:1) | 625 | 3.5 | 100 |
| | 750 | 3.5 | 100 |
| B:$C_{14}$ MEVEMEC[5] (1:1) | 625 | 3.0 | 80 |
| | 750 | 3.0 | 85 |
| B:$C_{14}$ Polyitaconate (1:1) | 625 | — | — |
| | 750 | 11 | 100 |
| B:$C_{14}$ FVAC[6] (1:1) | 625 | 0.5 | 100 |

[a]Wax residue after pumping 200 ml sample through 20 mesh filter (under vacuum of 500 mmHg) at 0° C. Sample cooled at 1° C. $h^{-1}$.

[b]Height of wax layer after 12 hours settling. Samples cooled at 1° C. $h^{-1}$.

[1]$C_{14}$ Itaconate/vinyl acetate copolymer

[2]$C_{16}$ ester of a styrene/maleic copolymer

[3]A mixed $C_{16}/C_{18}$ ester of a styrene/maleic anhydride copolymer

[4]A $C_{16}$ polymethacrylate

[5]A $C_{14}$ methyl/vinyl ether maleate ester copolymer

[6]A $C_{14}$ fumarate/vinyl acetate copolymer

EXAMPLE

Additive C was also tested in fuel 4 in combination with various other esters of polyhydroxy compounds and the results are set out in Table 6.

TABLE 6

| Additive (a) | Fuel 4 | Wax Residue (b) | Wax Layer (c) |
|---|---|---|---|
| C: Glycerol Tristerate | (4:1) | 24.5 | 70 C |
| | (1:1) | F | 70 C |
| | (1:4) | F | 100 |
| C: Pentaerythritol Tetra Stearate | (4:1) | F | 100 |
| | (1:1) | F | 60 C |
| | (1:4) | F | 100 |
| C: Sorbitol Hexapalmitate | (4:1) | 7.5 | 90 C |
| | (1:1) | 23.5 | 70 C |
| | (1:4) | 4 | 80 C |
| C: Crill 35 (B) | (4:1) | 1.5 | 50 C |
| | (1:1) | 1.5 | 50 C |
| | (1:4) | 2.5 | 100 |

(a) Treat rate 375 ppm at (b) Wax residue (%) after sucking sample (under 800 mmHg Vacuum) through a 20 mesh filter (c) Wax layer (vol/vol %) after 8 hrs setting at 0° C. 50 C. = Vol % of the cloudy layer above the wax layer

We claim:

1. An additive composition for improving the low temperature properties of distillate fuels having a cloud point above 0° C. and containing more than 5 wt. % wax at 10° C. below the cloud point comprising a mixture of a comb polymer of the general formula:

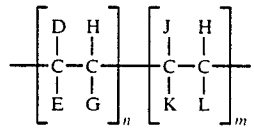

wherein:

D is selected from R, —CO.OR, —OCO.R, —R'-CO.OR and —OR;

E is selected from H, —$CH_3$, D and R';

G is selected from H and D;

J is selected from —H', R', —Aryl or a heterocyclic group, and —R'CO.OR;

K is selected from H, —CO.OR', —OCO.R', —OR' and —$CO_2H$;

L is selected from H, R', —CO.OR', —OCO.R', aryl and —$CO_2H$;

R is $\geqq C_{10}$n-alkyl, and R' is $\geqq C_1$ hydrocarbyl; and m and n are each molar ratios, m being 1.0 to 0.4 and n being 0.0 to 0.6, together with a co-additive selected from the group consisting of a poly alkyl ester, ether or ester/ether of a polyhydroxy compound.

2. The additive composition according to claim 1 in which the comb polymer is a copolymer of a fumarate ester and vinyl acetate.

3. The additive composition according to claim 1 in which the polyalkyl ester, ether or ester/ether of a polyhydroxy compound is a sorbitol tristearate.

4. Distillate fuels having a cloud point above 0° C. and containing more than 5 wt. % wax at 10° C. below the cloud point and containing 0.001 to 0.5 wt. % of a mixture of a comb polymer of the general formula:

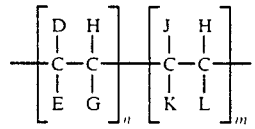

wherein:

D is selected from R, —CO.OR, —OCO.R, —R'-CO.OR and —OR;

E is selected from H, $CH_3$, D and R';

G is selected from H and D;

J is selected from —H', R', —Aryl and heterocyclic groups, and —R'CO.OR;

K is selected from H, —CO.OR', —OCO.R', —OR' and —$CO_2H$;

L is selected from H, R', —CO.OR', —OCO.R', aryl and —$CO_2H$;

R is $\geqq C_{10}$N-alkyl, and R' is $\geqq C_1$ hydrocarbyl; and m and n are each molar ratios, m being 1.0 to 0.4 and n being 0.0 to 0.6, together with a co-additive selected from the group consisting of a poly alkyl ester, ether or ester/ether of a polyhydroxy compound.

5. Distillate fuel according to claim 4 in which the comb polymer is a copolymer of a fumarate ester and vinyl acetate.

6. Distillate fuel according to claim 4 in which the polyalkyl ester, ether, ester/ether compound of a polyhydroxy compound is Sorbitol tristearate.

* * * * *